US011174147B2

(12) United States Patent
Mitsuhata et al.

(10) Patent No.: US 11,174,147 B2
(45) Date of Patent: Nov. 16, 2021

(54) CONVERSION DEVICE FOR CONVERTING MANUAL LIQUID SUPPLY DEVICE INTO AUTOMATIC LIQUID SUPPLY DEVICE, AND ATTACHING PLATE PROVIDED TO CONVERSION DEVICE

(71) Applicants: ASAHI GROUP HOLDINGS, LTD., Tokyo (JP); ASAHI BREWERIES, LTD., Tokyo (JP)

(72) Inventors: Shinsuke Mitsuhata, Moriya (JP); Tomohiro Takahashi, Moriya (JP); Takashi Wada, Kobe (JP); Toru Tanaka, Kobe (JP); Kenji Kusunoki, Kobe (JP)

(73) Assignees: ASAHI GROUP HOLDINGS, LTD., Tokyo (JP); ASAHI BREWERIES, LTD., Tokyo (JP)

( * ) Notice: Subject to any disclaimer, the term of this patent is extended or adjusted under 35 U.S.C. 154(b) by 223 days.

(21) Appl. No.: 16/463,667

(22) PCT Filed: Sep. 8, 2017

(86) PCT No.: PCT/JP2017/032401
§ 371 (c)(1),
(2) Date: May 23, 2019

(87) PCT Pub. No.: WO2018/100827
PCT Pub. Date: Jun. 7, 2018

(65) Prior Publication Data

US 2021/0114859 A1 Apr. 22, 2021

(30) Foreign Application Priority Data

Nov. 29, 2016 (JP) ..... JP2016-230765

(51) Int. Cl.
*B67D 1/14* (2006.01)

(52) U.S. Cl.
CPC .... *B67D 1/1405* (2013.01); *B67D 2001/1483* (2013.01)

(58) Field of Classification Search
CPC ..... B67D 1/1405; B67D 1/06; B67D 1/1477; B67D 1/08; B67D 1/0889; B67D 2001/1483; B67D 23/003
(Continued)

(56) References Cited

U.S. PATENT DOCUMENTS 5,505,340 A * 4/1996 McBride, Jr. ..... A47K 5/1211 222/135
6,131,773 A * 10/2000 Wade ..... A47K 5/1215 222/153.02
(Continued)

FOREIGN PATENT DOCUMENTS

JP 53-140366 A 12/1978
JP 60-186092 A 9/1985
(Continued)

OTHER PUBLICATIONS

English Translation of JP-2014223942, machine generated Feb. 2021 (Year: 2021).*
(Continued)

*Primary Examiner* — Benjamin R Shaw
(74) *Attorney, Agent, or Firm* — Sughrue Mion, PLLC

(57) ABSTRACT

There is provided a conversion device (150) configured to convert a manual liquid supply device (20) into an automated liquid supply device, the conversion device comprising an automated operation portion (51) and a mounting plate (110) made of a resin, the mounting plate including a back surface (110*b*), a front surface (110*a*), and a liquid discharging portion opening (111) passed through the front and back surfaces, and the conversion device further comprising spacers (120) configured to be interspersed between
(Continued)

the front surface of the mounting plate and the automated operation portion, and configured to create a gap between the front surface and the automated operation portion.

6 Claims, 12 Drawing Sheets

(58) Field of Classification Search
USPC ..... 222/544, 181.3
See application file for complete search history.

(56) References Cited

U.S. PATENT DOCUMENTS 6,540,110 B2 * 4/2003 Weiser ..... A47K 5/1215 222/103
7,086,568 B1 * 8/2006 Cheek ..... B65D 35/28 222/103
7,299,951 B2 * 11/2007 Jahnke ..... B05B 11/3052 222/179
7,320,418 B2 * 1/2008 Sassoon ..... A61L 2/18 222/1
7,845,520 B2 * 12/2010 Clark ..... A47K 10/32 222/181.3
7,883,065 B2 * 2/2011 Nelson ..... H04R 1/026 248/201
2002/0074353 A1 * 6/2002 Lewis ..... A47K 5/1204 222/156
2008/0283556 A1 * 11/2008 Snodgrass ..... A47K 5/13 222/325
2010/0252568 A1 * 10/2010 Ciavarella ..... A47K 5/1202 222/1
2012/0228326 A1 * 9/2012 Ciavarella ..... G09F 23/00 222/108

FOREIGN PATENT DOCUMENTS

JP 2002-29594 A 1/2002
JP 2014-223942 A 12/2014
JP 2014-223943 A 12/2014
JP 2014223942 A * 12/2014 ..... B67D 1/1477
JP 2016-117500 A 6/2016

OTHER PUBLICATIONS

Communication dated May 29, 2020 from European Patent Office in EP Application No. 17876935.2.
International Preliminary Report on Patentability with translation of Written Opinion dated Jun. 4, 2019, in counterpart International Application No. PCT/JP2017/032401.
International Search Report for PCT/JP2017/032401 dated Oct. 31, 2017 [PCT/ISA/210].

* cited by examiner

CONVERSION DEVICE FOR CONVERTING MANUAL LIQUID SUPPLY DEVICE INTO AUTOMATIC LIQUID SUPPLY DEVICE, AND ATTACHING PLATE PROVIDED TO CONVERSION DEVICE

CROSS REFERENCE TO RELATED APPLICATIONS

This application is a National Stage of International Application No. PCT/JP2017/032401, filed on Sep. 8, 2017, which claims priority from Japanese Patent Application No. 2016-230765, filed on Nov. 29, 2016.

TECHNICAL FIELD

The present invention relates to a conversion device, adapted to be mounted to a manual liquid supply device, for converting the manual liquid supply device into an automated liquid supply device and, further, relates to a mounting plate included in the conversion device.

BACKGROUND ART

A conversion device adapted to be mounted to a manual liquid supply device for converting this manual liquid supply device into an automated liquid supply device has been already suggested by the applicant of the present application and has been sold (refer to Patent Documents 1 and 2, for example). More specifically, the aforementioned conversion device can be mounted to a manual beer server including a manual operation lever without necessitating modification of the manual beer server. The conversion device is adapted to operate the operation lever and then automatically to pour beer into a mug when an operator just pushes an operation button included in the conversion device.

PRIOR ART DOCUMENTS

Patent Documents

Patent Document 1: JP 2014-223942 A
Patent Document 2: JP 2014-223943 A

SUMMARY OF THE INVENTION

Problems to be Solved by the Invention

As described above, the existing conversion device has been developed under the design concept of enabling mounting of the conversion device to a manual beer server without altering the manual beer server. As a result thereof, the conversion device made by the present applicant can be mounted to manual beer servers manufactured by almost all makers. Thus, this provides an overwhelming advantage of enabling pouring beer with certain quality regardless of the beer pouring skills of restaurant staffs and, further, largely contributes to reduction of labors of staffs and the like.

On the other hand, due to the aforementioned design concept, the conversion device needs to include structures for mounting and securing the device to the manual beer server, and the conversion device has points to be overcome, which are induced by such mounting and securing structures. Therefore, the existing conversion device still has rooms for improvement, in fact.

So, it is an object of the present invention to provide a conversion device which has been further improved and heightened in perfection and, further, to provide a mounting plate included in the conversion device.

Means for Solving the Problems

In order to attain the aforementioned object, there is provided a configuration, according to the present invention.

Namely, in one aspect of the present invention, there is provided a conversion device configured to convert a manual liquid supply device into an automated liquid supply device by mounting the conversion device to the manual liquid supply device including a liquid discharging portion, the liquid discharging portion being protruded from a mounting surface in the manual liquid supply device and discharging or stopping liquid with an operation of a manual operation member in the liquid discharging portion, the conversion device comprising:

an automated operation portion configured to automatically operate the manual operation member; and a mounting plate made of a resin, positioned between the automated operation portion and the mounting surface, and configured to mount the automated operation portion to the mounting surface, the mounting plate including: a back surface facing to the manual liquid supply device and coming in contact with the mounting surface; a front surface opposed to the back surface and facing to the automated operation portion; and a liquid discharging portion opening passed through the front and back surfaces and through which the liquid discharging portion is inserted, and the conversion device further comprising a spacer configured to be interspersed and sandwiched between the front surface and the automated operation portion, and configured to create a gap between the front surface and the automated operation portion.

Effects of the Invention

Since the aforementioned conversion device includes the spacer between the automated operation portion and the front surface of the mounting plate, it is possible to create a gap between the automated operation portion and the front surface of the mounting plate. On the other hand, under the design concept explained above in the existing conversion device, the device has a larger contact area between a base plate corresponding to the mounting plate and a conversion device main body corresponding to the automated operation portion, as a structure for mounting and securing the conversion device to the manual beer server. As a result thereof, there is a possibility of adhesion of the base plate and the conversion device main body to each other, due to beer penetrated into a contact portion with the larger contact area, as one of the points to be overcome. In order to improve the point to be overcome, providing the spacer makes it possible to reduce a contact area between the mounting plate and the automated operation portion and inhibit the possibility of adhesion therebetween.

EMBODIMENTS OF THE INVENTION

Figure 1:
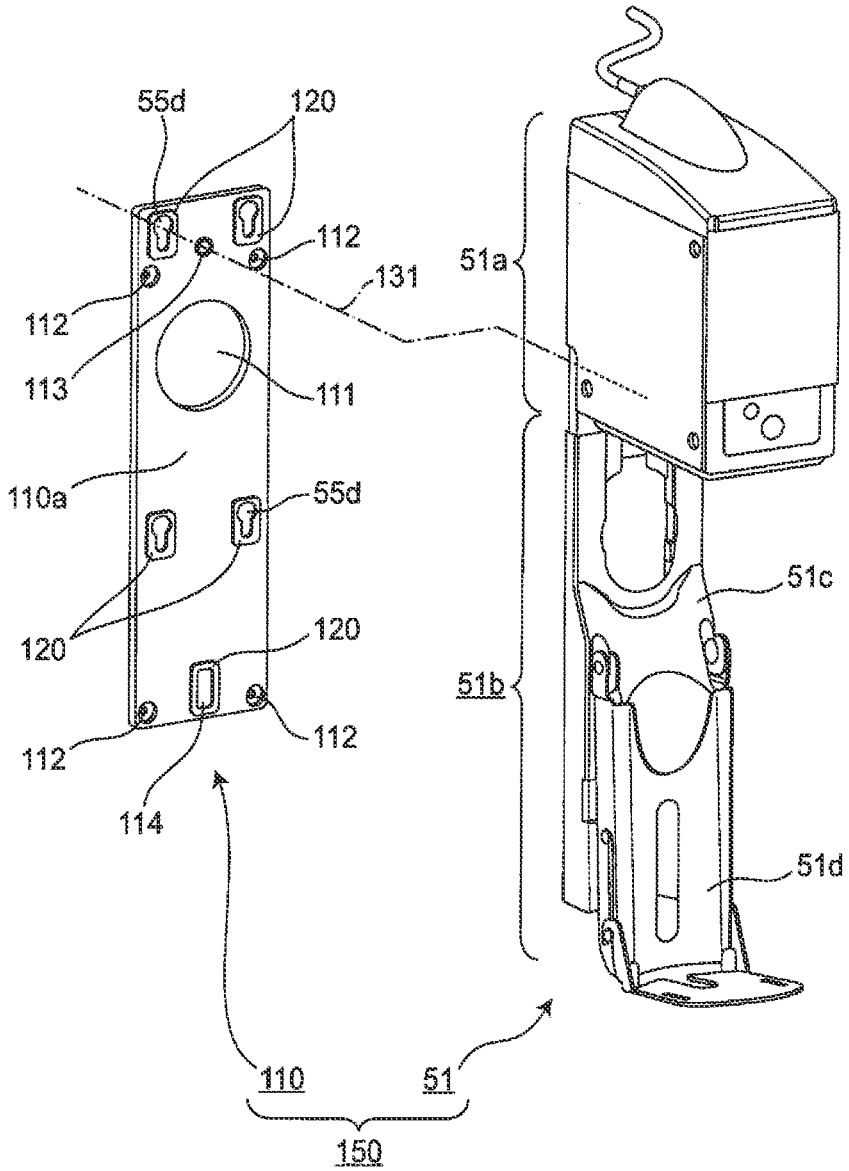
FIG. 1 is a perspective view illustrating the structure of a conversion device according to an embodiment of the present invention.

Hereinafter, there will be described a conversion device for converting a manual liquid supply device into an automated liquid supply device according to an embodiment of the present invention, with reference to the drawings. Incidentally, throughout the drawings, the same or similar components are designated by the same reference characters. Further, in order to avoid unnecessary redundancy of the following descriptions for enabling those skilled in the art to easily understand them, matters which have been well known already will not be described in detail, and substantially the same structures will not be described redundantly, in some cases. Further, the contents of the following descriptions and the accompanying drawings are not intended to restrict the subjects defined by the claims.

Further, in the following embodiment, there will be exemplified a beer dispenser, namely a beer server, as an example of a liquid supply device, but the liquid supply device is not limited to be used for beer. Namely, the conversion device according to the embodiment is applicable to any manual liquid supply device which includes a manual operation member which can be operated by an operator, and which is capable of ejecting liquid when the manual operation member is operated.

Before describing about the conversion device according to the present embodiment, an existing conversion device will be described in brief, at first, with reference to FIGS. 10 to 12.

Figure 10:
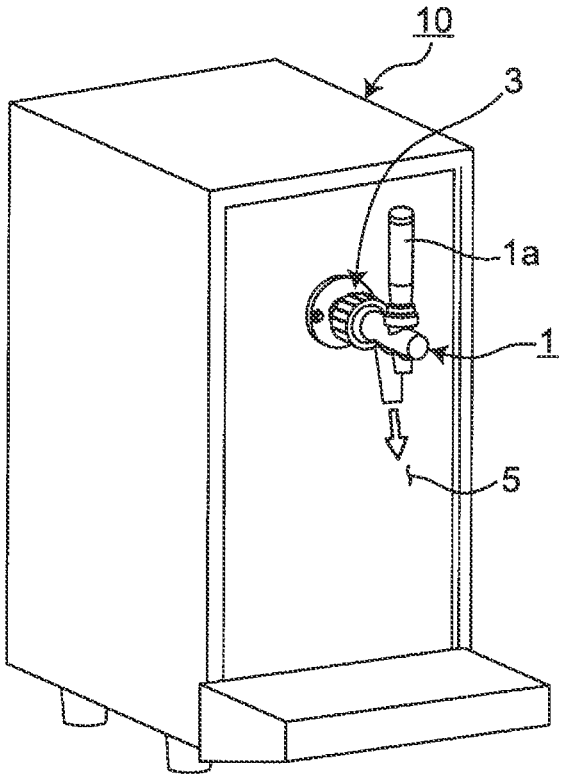
FIG. 10 is a perspective view illustrating an existing manual beer server.

A manual beer server 10 illustrated in FIG. 10, which corresponds to an example of "a manual liquid supply device", has conventionally existed. In the manual beer server 10, a liquid discharging portion 1 is protruded from a main body wall portion 5 which corresponds to an example of "a mounting surface", with a lever mounting portion 3 interposed therebetween. For example, an operator such as a restaurant staff is enabled to discharge beer and foams into a mug and to stop them, by inclining an operation lever 1*a* in the manual beer server 10. Further, the liquid discharging portion 1 is made attachable and detachable to and from the lever mounting portion 3 in order to enable washing it.

Figure 11:
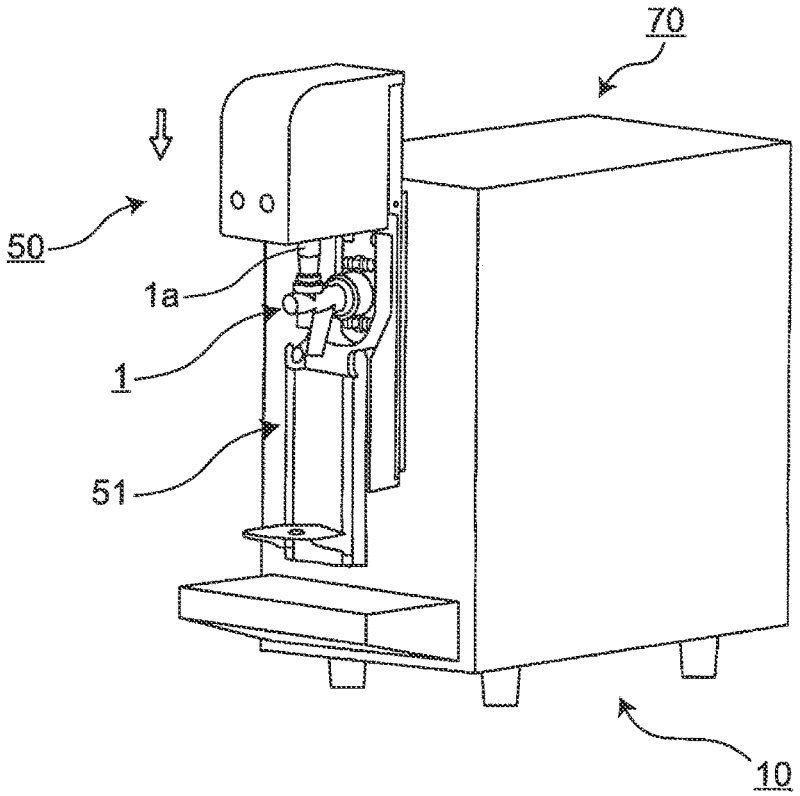
FIG. 11 is a perspective view illustrating a state where an existing conversion device has been mounted to the manual beer server illustrated in FIG. 10.

An existing conversion device 50 illustrated in FIG. 11 is a device for converting the manual beer server 10 into an automated beer dispenser 70 corresponding to an example of an automated liquid supply device, by being simply retrofitted to the manual beer server 10, without necessitating modification of the manual beer server 10.

Figure 12:
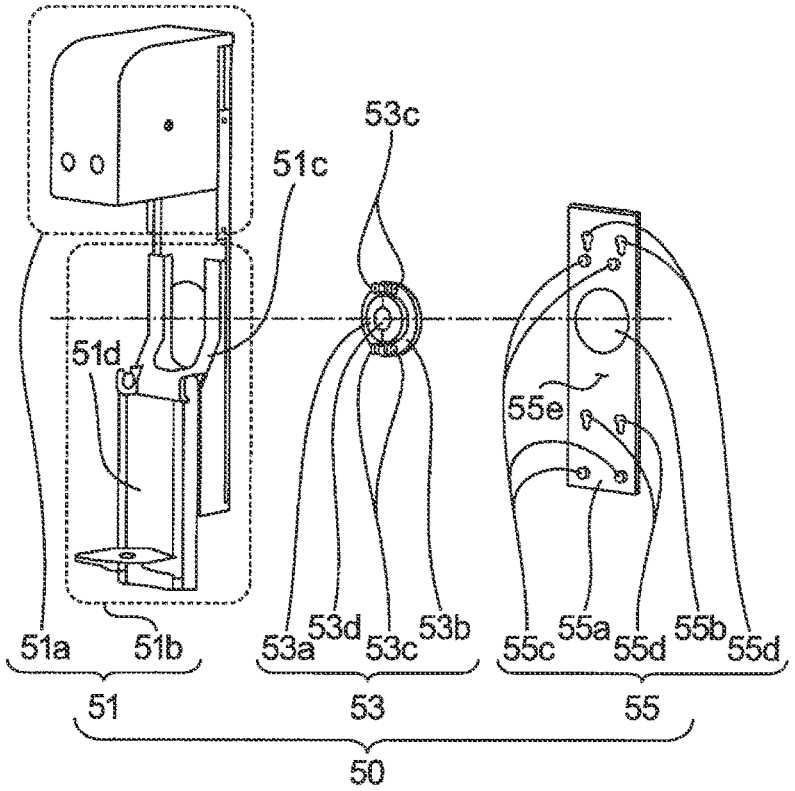
FIG. 12 is a perspective view illustrating the structure of the existing conversion device.

The conversion device 50 as described above includes a conversion device main body 51, a fixing ring 53 and a mounting base 55 as basic components, as illustrated in FIG. 12. In this case, the conversion device main body 51 is a component for enabling the operation lever 1*a* in the manual beer server 10 to be automatically operated. Further, the fixing ring 53 and the mounting base 55 are members for securing the conversion device main body 51 onto the manual beer server 10.

The conversion device main body 51 includes a lever operation portion 51*a* at its upper portion, and a mug inclination portion 51*b* at its lower portion. The lever operation portion 51*a* mainly includes, thereinside, a lever operation mechanism for performing operations for inclining the operation lever 1*a*. Further, the lever operation portion 51*a* is structured to be movable upwardly and downwardly along a predetermined rail (not illustrated), similarly to in conventional manners. The mug inclination portion 51*b* includes a lower-portion cover 51*c* and also mainly includes a mug inclination mechanism thereinside, and this mug inclination mechanism is a mechanism for inclining a mug placing plate 51*d* for placing a mug thereon.

Further, the lever operation mechanism in the lever operation portion 51*a* and the mug inclination mechanism in the mug inclination portion 51*b* have the same structures as those of the respective mechanisms disclosed in the aforementioned Patent Documents 1 and 2. Therefore, they are not described herein.

The mounting base 55 is formed with a metal plate member. The mounting base 55 is a member for mounting the conversion device main body 51 onto the main body wall portion 5 in the manual beer server 10 and includes a base plate 55*a* and base plate fixing bolts 55*c*. The base plate 55*a* is provided with a base plate mounting opening 55*b*, and a plurality of main body mounting openings 55*d* surrounding the base plate mounting opening 55*b*.

The base plate mounting opening 55*b* is formed at the center of the base plate 55*a* in the widthwise direction orthogonal to the longitudinal direction thereof and, further, has a size enough to insert, therethrough, the lever mounting portion 3 in the manual beer server 10. Accordingly, the base plate mounting opening 55*b* is an opening for mounting the mounting base 55 to the lever mounting portion 3.

Further, the main body mounting openings 55*d* are openings for latching and mounting the conversion device main body 51 onto the mounting base 55.

The base plate fixing bolts 55*c* are bolts which can be adjusted in amount of protrusion from the base plate 55*a* toward the main body wall portion 5 of the manual beer server 10, since the base plate fixing bolts 55*c* are screwed into the base plate 55*a*. These base plate fixing bolts 55*c* are bolts for pressing the mounting base 55 toward the lever mounting portion 3 in order to secure the mounting base 55, by pushing out the bolts 55*c* against the main body wall portion 5, as will be described later.

The fixing ring 53 is a member used for pressing and securing the mounting base 55 with respect to the lever mounting portion 3, as described above. The fixing ring 53 includes two split fixing rings 53*a* and 53*b*, and split-fixing-ring coupling bolts 53*c*. The split fixing rings 53*a* and 53*b* are two-split members having respective half-circular shapes, and the split fixing rings 53*a* and 53*b* are coupled to each other through the split-fixing-ring coupling bolts 53*c* to be integrated. Further, as a result of the integration of them, there is formed a fixing-ring mounting opening 53*d* at a center portion of the fixing ring 53.

Next, there will be described a method for mounting and securing the mounting base 55 onto the main body wall portion 5 in the manual beer server 10, using the fixing ring 53 and the mounting base 55 which have been described above, with reference to FIGS. 13 to 16.

Figure 13:
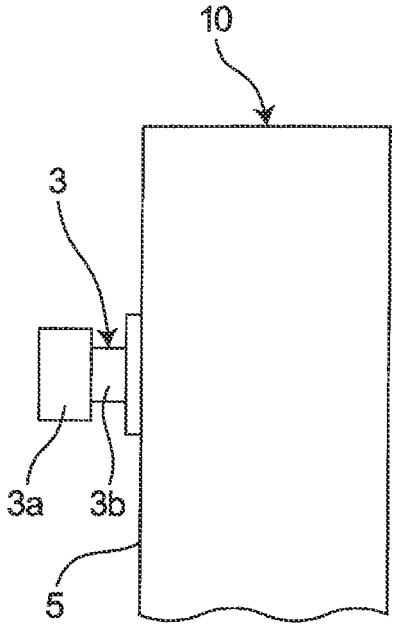
FIG. 13 is a side view of the manual beer server illustrated in FIG. 10, illustrating a state where a liquid discharging portion has been detached therefrom.

At first, as illustrated in FIG. 13, the liquid discharging portion 1 in the manual beer server 10 is detached, thereby realizing a state where only the lever mounting portion 3 is protruded from the main body wall portion 5.

Figure 14:
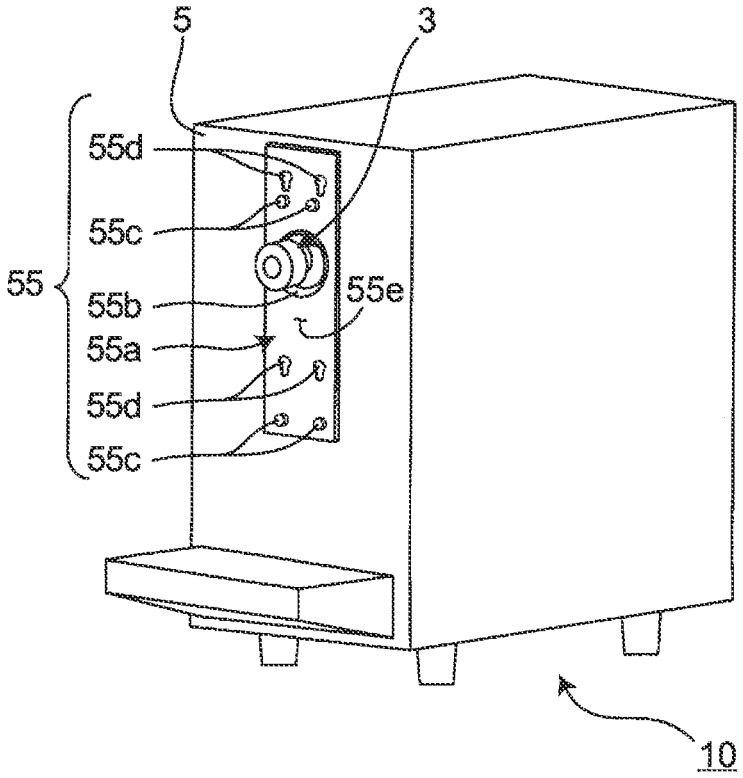
FIG. 14 is a perspective view illustrating a state where a base plate included in the existing conversion device has been mounted to the manual beer server illustrated in FIG. 10.

Next, as illustrated in FIG. 14, the base plate mounting opening 55*b* in the mounting base 55 is inserted around the lever mounting portion 3, and the base plate 55*a* is placed along the main body wall portion 5.

Figure 15:
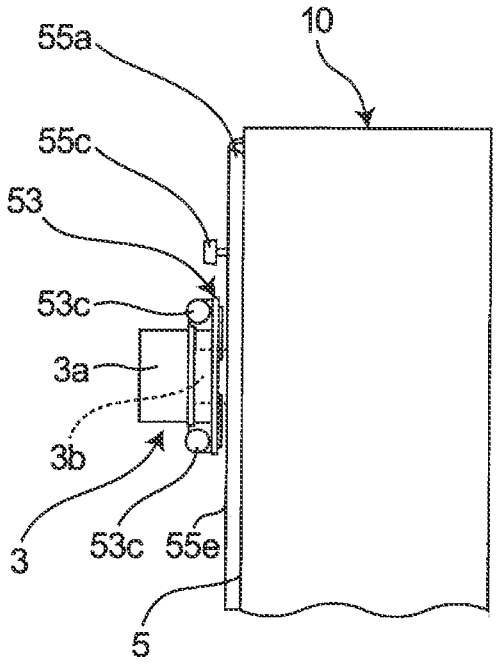
FIG. 15 is a view for explaining operations for mounting the base plate included in the existing conversion device to the manual beer server illustrated in FIG. 10.

Next, as illustrated in FIG. 15, at the lever mounting portion 3, the fixing ring 53 is disposed between a cap nut 3*a* and the base plate 55*a*. More specifically, a shank 3*b* (FIG. 13) in the lever mounting portion 3 is caught between the two split fixing rings 53*a* and 53*b*, and these split fixing rings 53*a* and 53*b* are coupled to each other through the split-fixing-ring coupling bolts 53*c*, so that the fixing ring 53 is secured to the lever mounting portion 3. At this time, the fixing-ring mounting opening 53*d* in the fixing ring 53 has a smaller diameter than that of the cap nut 3*a*, which prevents the fixing ring 53 from being disengaged from the lever mounting portion 3.

Thus, the base plate 55*a* has been mounted to the manual beer server 10 in a state that the base plate 55*a* is sandwiched between the fixing ring 53 and the main body wall portion 5 in the manual beer server 10.

Figure 16:
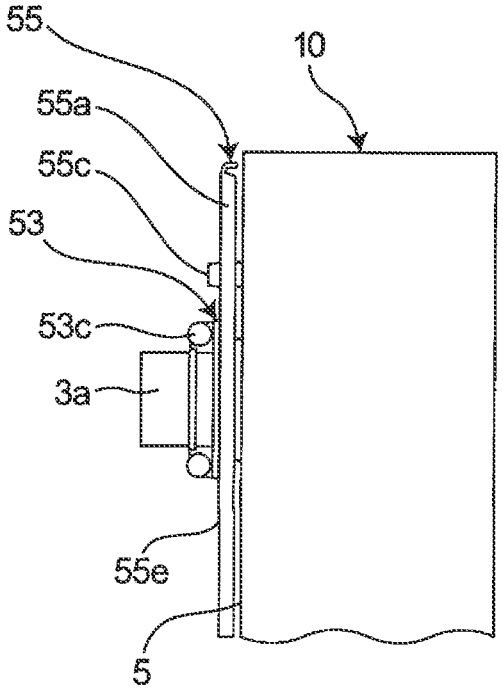
FIG. 16 is a view for explaining the operations for mounting the base plate included in the existing conversion device to the manual beer server illustrated in FIG. 10.

Further, the base plate fixing bolts 55*c* in the mounting base 55 are rotated in such a way as to proceed from the base plate 55*a* toward the main body wall portion 5 in the manual beer server 10. On the other hand, the base plate 55*a* is restricted in movement by the fixing ring 53. Accordingly, by rotating the base plate fixing bolts 55*c* even after the tip ends of the base plate fixing bolts 55*c* have reached on the main body wall portion 5, the base plate fixing bolts 55*c* function as tension rods. As a result thereof, as illustrated in FIG. 16, the base plate 55*a* is certainly secured to the main body wall portion 5 in the manual beer server 10.

Figure 17:
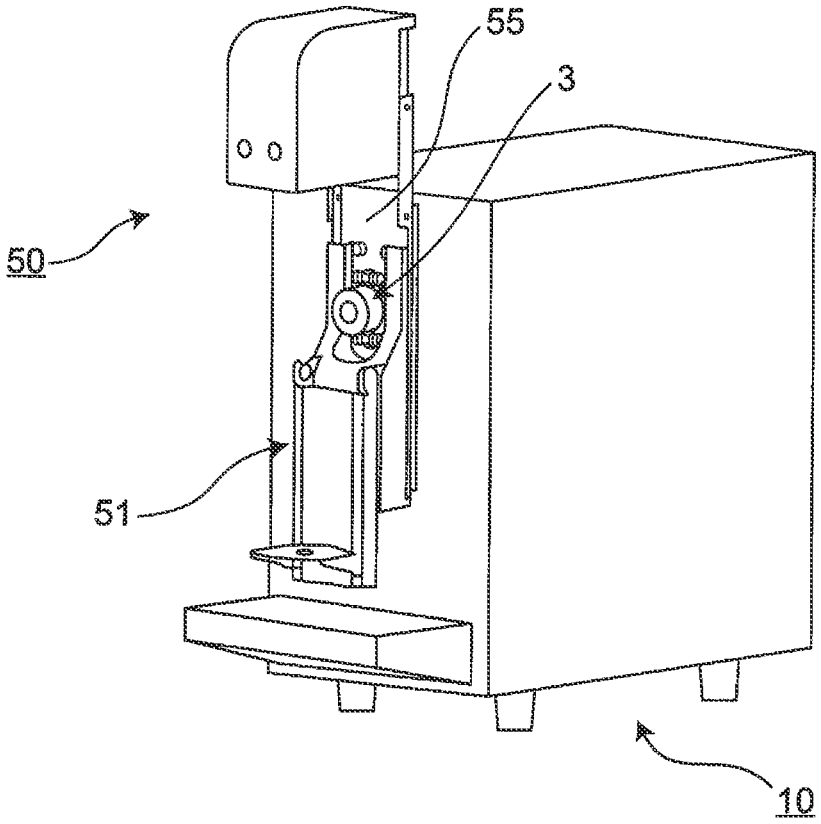
FIG. 17 is a perspective view for explaining a state where a conversion device main body included in the existing conversion device has been mounted to the base plate illustrated in FIG. 16.

With respect to the mounting base 55 having been secured to the main body wall portion 5 in the manual beer server 10 through the aforementioned operations, as illustrated in FIG. 17, mounting protrusions (not illustrated) in the conversion device main body 51 are fitted into the main body mounting openings 55*d* (FIG. 14) in the base plate 55*a*. Thus, the conversion device main body 51 can be mounted to the base plate 55*a* and, therefore, to the manual beer server 10.

Further, the liquid discharging portion 1 which has been detached is mounted to the lever mounting portion 3. Next, the lever operation portion 51*a* is moved downwardly and is set such that the operation lever 1*a* is settled at a predetermined position in the lever operation portion 51*a* (FIG. 11).

Therefore, the manual beer server 10 has been made to form an automated beer dispenser 70 through the conversion device 50.

Incidentally, means for certainly securing the base plate 55*a* to the main body wall portion 5 in the manual beer server 10 is not limited to the aforementioned base plate fixing bolts 55*c*. Namely, this means can be any pressing means capable of functioning as tension rods.

As described above, the existing conversion device 50 is configured based on the design concept of performing no modification for mounting the conversion device 50 to the conventional manual beer server 10. As a merit thereof, the conversion device 50 can be mounted to manual beer servers manufactured by almost all makers, and can automate them, as described above. This is a significantly excellent advantage.

On the other hand, in the mounting base 55 for mounting the conversion device main body 51 to the manual beer server 10, the base plate 55*a* is pressed against the fixing ring 53 through pressing means such as the base plate fixing bolts 55*c*, for example, in order to secure the base plate 55*a* onto the main body wall portion 5 in the manual beer server 10. Further, while there are plural positions at which the pressing means such as the base plate fixing bolts 55*c* is pushed out, there is only a single position, namely a position of the fixing ring 53, to which the base plate 55*a* is pressed. Due to these facts, the base plate 55*a* is required to have rigidity enough to withstand at least pressing (pressing operations), then in the conversion device 50, the base plate 55*a* is formed of a metal plate. Further, a supporting surface 55*e* (FIGS. 12 and 15 and the like) of the base plate 55*a*, which comes in contact with the conversion device main body 51 and supports it, is made to from a flat surface and, further, is made to have a contact area with the conversion device main body 51 as large as possible, in consideration of deformation due to the aforementioned pressing.

On the other hand, due to the nature of the automated beer dispenser 70, the conversion device main body 51 may be splashed with beer due to spilling and the like of beer, for example. Further, it is also considered that beer may intrude into contact portions between the conversion device main body 51 and the supporting surface 55*e* of the base plate 55*a*. When the intruded beer has been dried, the supporting surface 55*e* and the conversion device main body 51 can be adhered to each other. This raises concern about inconvenience at the time of maintenance of the conversion device 50.

Further, as described above, because of securing the base plate 55*a* through pressing operations, there is a need for the fixing ring 53 and the pressing means such as the base plate fixing bolts 55*c*. This consequently involves an increase of the number of members, which naturally requires time for operations for mounting them, and the like.

A conversion device according to the present embodiment has been improved over the aforementioned existing conversion device 50, in terms of the points of the existing conversion device 50 which should be overcome.

Further, in the conversion device according to the present embodiment, slight modification is performed on the manual beer server 10 in order to mount the conversion device according to the present embodiment to the manual beer server 10, based on a new design concept.

These points will be described in detail below.

Figure 2:
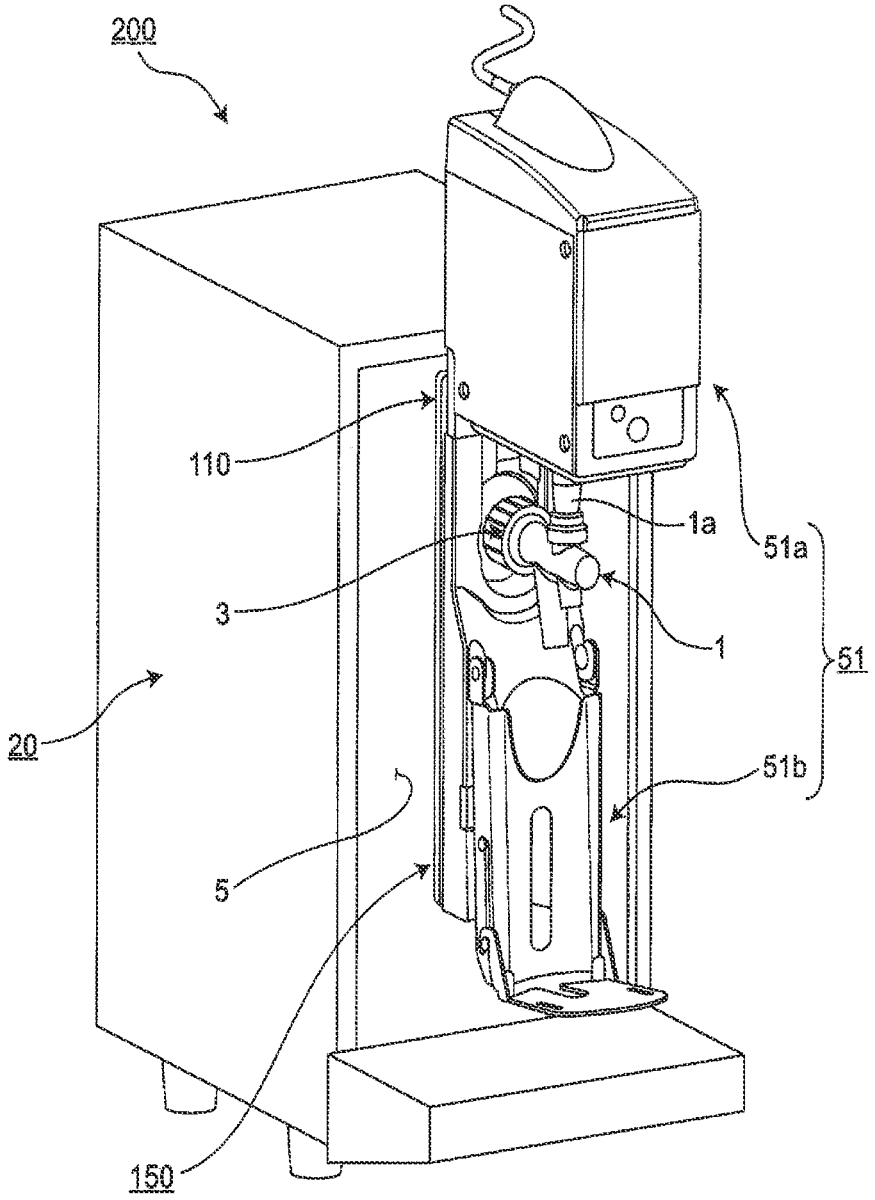
FIG. 2 is a perspective view illustrating an automated beer dispenser in a state where the conversion device illustrated in FIG. 1 has been mounted to a manual beer server.

FIG. 1 illustrates a conversion device 150 according to the present embodiment, and FIG. 2 illustrates an automated liquid supply device constructed by mounting the conversion device 150 to a manual liquid supply device. In this case, the conversion device 150 is a device for converting the manual liquid supply device into the automated liquid supply device similarly to the existing conversion device 50. Further, the device corresponding to an example of the manual liquid supply device is a manual beer server 20 illustrated in FIG. 7, and the device corresponding to an example of the automated liquid supply device is an automated beer dispenser 200 illustrated in FIG. 2.

On the other hand, the conversion device 150 according to the present embodiment is configured based on the new design concept of performing slight modification with respect to the existing manual beer server in order to mount the conversion device 150 thereto. More specifically, as will be described later in detail, the manual beer server 20 illustrated in FIG. 7 includes screw holes 21 for mounting the conversion device 150 in the present embodiment. Further, the screw holes 21 correspond to an example of engagement portions to be engaged with fastening members which will be described later.

Under this new design concept, the conversion device 150 according to the present embodiment includes a conversion device main body 51, a mounting plate 110, and spacers 120, as illustrated in FIG. 1. Accordingly, this conversion device 150 does not include the fixing ring 53 and the base plate fixing bolts 55*c* (the pressing means), which enables reduction of the number of members, in comparison with the existing conversion device 50. As a result thereof, with the conversion device 150, it is possible to provide the advantages of reduction of the cost, reduction of mounting operation times, and the like, in comparison with the existing conversion device 50.

Hereinafter, the conversion device main body 51, the mounting plate 110 and the spacers 120 will be described sequentially.

Figure 7:
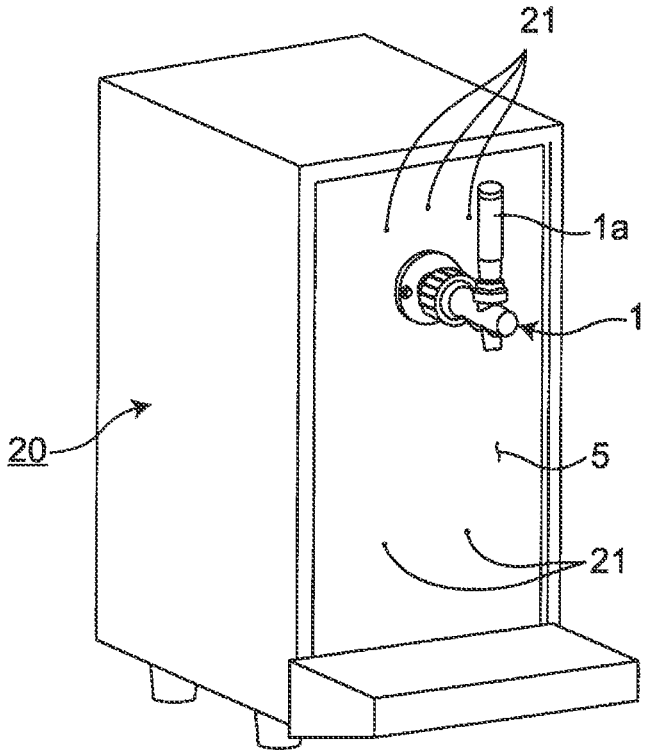
FIG. 7 is a perspective view illustrating the manual beer server illustrated in FIG. 2.

The conversion device main body 51 is the same as that included in the aforementioned conversion device 50 and corresponds to an example of an automated operation portion for automatically operating a manual operation member in the manual beer server 20 in FIG. 7. Accordingly, the conversion device main body 51 is not described in detail here. The conversion device main body 51 includes the lever operation portion 51*a* at its upper portion, and the mug inclination portion 51*b* at its lower portion. Incidentally, the aforementioned manual operation member corresponds to the operation lever 1*a* in the liquid discharging portion 1 illustrated in FIG. 7.

Next, the mounting plate 110 will be described.

The mounting plate 110 is a member corresponding to the mounting base 55 included in the aforementioned conversion device 50. The mounting plate 110 is a member which is positioned between the conversion device main body 51 in the conversion device 150 according to the present embodiment and the main body wall portion 5 in the manual beer server 20 for securing the conversion device main body 51 to the manual beer server 20. Further, the main body wall portion 5 corresponds to an example of "the mounting surface".

Figure 3A:
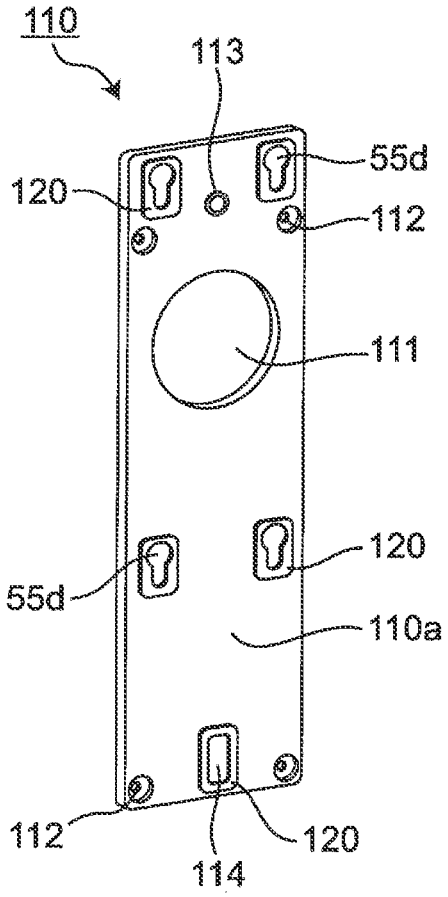
FIG. 3A is a perspective view illustrating the front-surface side of a mounting plate included in the conversion device illustrated in FIG. 1.
Figure 3B:
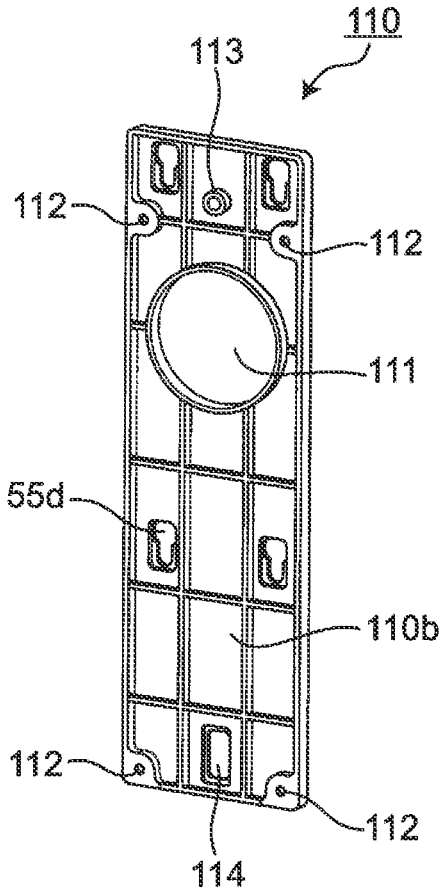
FIG. 3B is a perspective view illustrating the back-surface side of the mounting plate included in the conversion device illustrated in FIG. 1.

More specifically, in the present embodiment, the mounting plate 110 is made of a resin and molded using polyacetal, for example, and includes a back surface 110*b* which comes in contact with the main body wall portion 5 and faces the manual beer server 20, a front surface 110*a* which is opposed to the back surface 110*b* and faces the conversion device main body 51, and a liquid discharging portion opening 111 which is penetrated through the front surface 110*a* and the back surface 110*b* and is adapted to insert the liquid discharging portion 1 therethrough, as illustrated in FIGS. 3A and 3B. Further, the mounting plate 110 includes main body mounting openings 55*d*, similarly to the mounting base 55 included in the conversion device 50. Further, the main body mounting openings 55*d* are hole portions to and with which hook members 51*f* protruded from a base plate 51 in the conversion device main body 51 are fitted and engaged. In the present embodiment, the main body mounting openings 55*d* are made to have a shape in which a part of the round shape is tapered, as illustrated in FIG. 1.

Furthermore, the mounting plate 110 newly includes fastening-member holes 112, a reinforcement fastening-member hole 113, a latch opening 114, and the spacers 120 which will be described hereinafter.

The fastening-member holes 112 are holes for inserting, therethrough, fastening members 130 (FIG. 8) for securing the mounting plate 110 onto the main body wall portion 5 in the manual beer server 20. The fastening-member holes 112 are arranged at four corners of the mounting plate 110. Further, the fastening-member holes 112 include counterbores respectively around their peripheries in order to prevent heads of the fastening members 130 from protruding from the front surface 110*a*. Further, the mounting plate 110 just has to have at least three fastening members 130, since stable mounting of the mounting plate 110 can be achieved with at least three positions. Accordingly, the number of the fastening-member holes 112 is not limited to four and can be any number equal to or more than three.

Figure 8:
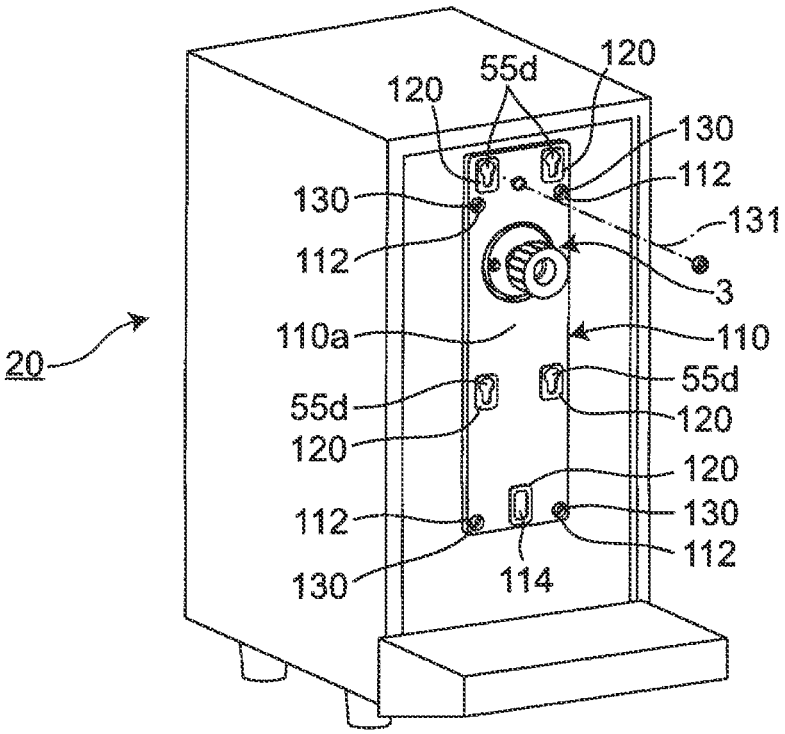
FIG. 8 is a perspective view illustrating a state where the mounting plate illustrated in FIG. 1 has been secured to the manual beer server illustrated in FIG. 2.

The reinforcement fastening-member hole 113, in other words, a reinforcement fastening member 131 illustrated in FIGS. 1 and 8, is provided for the following reasons. That is, the mounting plate 110 and the conversion device main body 51 are attached with each other by engaging the main body mounting openings 55*d* in the mounting plate 110 with the hook members 51*f* (FIG. 6) protruded from the base plate 51*e* in the conversion device main body 51. In order to reinforce this engagement state, even if an excessive external force is exerted to the conversion device main body 51, due to collision of a person with the conversion device main body 51, for example, there is provided the reinforcement fastening member 131 (FIGS. 1 and 8) which is simply penetrated through the mounting plate 110 for directly fastening between the lever operation portion 51*a* in the conversion device main body 51 and the main body wall portion 5 in the manual beer server 20, in the present embodiment. The reinforcement fastening-member hole 113 is a hole through which the reinforcement fastening member 131 is penetrated without being engaged therewith. Further, there just has to provide at least one reinforcement fastening member 131.

Further, the reinforcement fastening member 131 is disposed at the center of the mounting plate 110 in the widthwise direction orthogonal to the longitudinal direction of the mounting plate 110. Namely, the reinforcement fastening member 131 is positioned at the center between the two main body mounting openings 55*d* which are positioned in the left and right sides of the mounting plate 110 in the widthwise direction. Since the reinforcement fastening member 131 is disposed in association with the positions of the main body mounting openings 55*d* as described above, it is possible to prevent the mounting plate 110 from unevenly damaging, even if an excessive external force described above is exerted on any of the left and right sides in the widthwise direction with respect to the conversion device main body 51. Further, the location of the reinforcement fastening member 131 in the mounting plate 110 is not limited to the aforementioned center.

Further, the latch opening 114 is an opening with which a latch claw 51*g* (FIG. 6) provided at the lower end of the conversion device main body 51 is engaged.

Next, the spacers 120 will be described.

Figure 4:
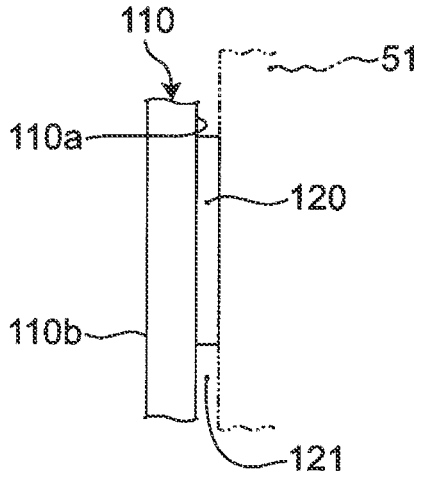
FIG. 4 is a view illustrating a spacer included in the conversion device illustrated in FIG. 1.

The spacers 120 are members which are interspersed on the mounting plate 110 while being sandwiched between the front surface 110*a* of the mounting plate 110 and the conversion device main body 51, thereby generating a gap 121 between the front surface 110*a* and the conversion device main body 51, as illustrated in FIG. 4. There just has to be at least three spacers 120 interspersed between the front surface 110*a* and the conversion device main body 51. By interspersing at least three spacers 120, it is possible to stably install the conversion device main body 51 onto the mounting plate 110 without inducing wobble. Further, the surfaces of the spacers 120 which come in contact with the conversion device main body 51 are made with flat surfaces in order to stably install the conversion device main body 51 thereon.

In the present embodiment, as illustrated in FIGS. 1 and 3A, the spacers 120 are placed to form respective rectangular shapes around the main body mounting openings 55*d* and the latch opening 114 in the mounting plate 110 and are formed integrally with the mounting plate 110 in such a way as to protrude from the front surface 110*a*. The provision of the spacers 120 together with the main body mounting openings 55*d* and the latch opening 114 as described above is advantageous in view of forming the spacers 120 and, also, is advantageous in view of stability of mounting of the conversion device main body 51 onto the mounting plate 110.

Further, since the spacers 120 just have to be at least three portions as described above, it is not necessarily required to provide the spacer 120 around the latch opening 114.

The size of the spacers 120 is properly determined in consideration of the aim of the installation thereof, namely in consideration of prevention of adhesion between the conversion device main body 51 and the front surface 110*a* of the mounting plate 110. Particularly, the thickness of the spacers 120 is selected to be such a value as to inhibit spilled liquid from being stagnated in the gap formed between the conversion device main body 51 and the front surface 110*a* of the mounting plate 110.

In view of the aforementioned circumstances, the thickness of the spacers 120 is about 1 mm to 3 mm, in general. If the thickness of the spacers 120 is less than 1 mm, spilled liquid tends to be stagnated in the gap 121 formed by the spacers 120. On the other hand, if the thickness of the spacers 120 exceeds 3 mm, this may make the strength of the mounting of the conversion device main body 51 insufficient and may make the attitude of the mounting thereof instable.

Incidentally, in the present embodiment, for example, the thickness of each of the spacers 120 is made to be 2 mm.

Further, in view of the size of the spacers 120, a contact area formed with the spacers 120 and the conversion device main body 51 has such a size as to allow an operator to easily separate the conversion device main body 51 from the mounting plate 110 with his or her hands, even when liquid has been penetrated into their contact portions and has been dried therein.

In view of the aforementioned circumstances, total of the contact areas of all spacers 120 is equal to or less than about 1/5 of the area of the front surface 110*a* of the mounting plate 110, preferably equal to or less than about 1/10 thereof, and more preferably equal to or less than about 1/12 thereof. If the total of the contact areas of all the spacers 120 is larger than about 1/5 of the area of the front surface 110*a* of the mounting plate 110, the mounting plate 110 and the conversion device main body 51 may be firmly adhered to each other, which may cause the operator to find difficulty in separating the conversion device main body 51 from the mounting plate 110 with his or her hands. The lower limit value of the total of the contact areas of all the spacers 120 is not particularly limited. However, the total of the contact areas of all the spacers 120 is required to have a value necessary for ensuring stability of the mounting of the conversion device main body 51. In view of such circumstances, the lower limit value of the total of the contact areas of all the spacers 120 is equal to or more than about 1/30 of the area of the front surface 110*a* of the mounting plate 110, preferably equal to or more than about 1/25 thereof and more preferably equal to or more than about 1/20 thereof.

Due to the provision of the spacers 120 as described above, there is no case that the front surface 110*a* of the mounting plate 110 and the conversion device main body 51 come in contact with each other in their whole surfaces, unlike the case of using the existing base plate 55*a*. Accordingly, for example, even if the conversion device main body 51 is splashed with beer, and the beer is dried therein, there is hardly a possibility that the front surface 110*a* of the mounting plate 110 is adhered to the conversion device main body 51. This can provide the advantage of substantially eliminating the possibility of occurrences of inconvenience at the time of maintenance of the conversion device 150.

Further, since the spacers 120 have the function of preventing adhesion as described above, the spacers 120 can be also differently referred to as "an adhesion preventing member".

Further, the locations at which the spacers 120 are positioned are not limited to the peripheries of the main body mounting openings 55*d* and the latch opening 114 according to the present embodiment. For example, as in a mounting plate 110-1 illustrated in FIG. 5, the spacers 120 can be also positioned in such a way as to protrude from the front surface 110*a*, at least at three locations on the front surface 110*a*. The mounting plate 110-1 is also made of a resin, and the spacers 120 can be molded integrally with the mounting plate 110-1. Further, by disposing the spacers 120 at any location thereon, it is possible to position the spacers 120 in association with portions which are less prone to penetrate of beer, for example.

Figure 6:
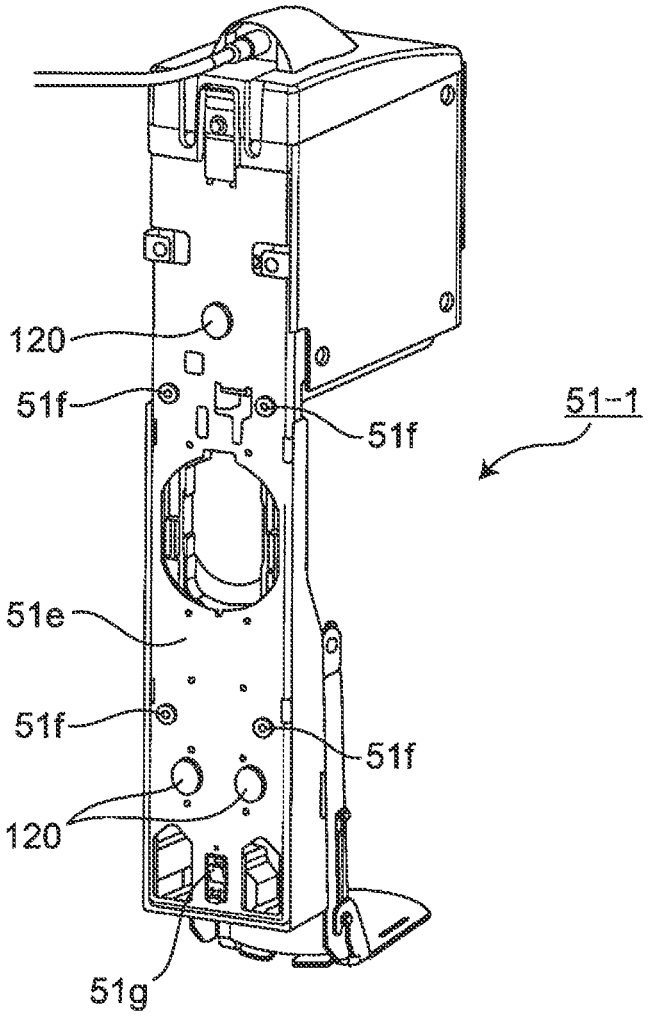
FIG. 6 is a perspective view of a conversion device main body, illustrating a case where the spacers included in the conversion device illustrated in FIG. 1 are provided on the conversion device main body.

Further, as in a conversion device main body 51-1 illustrated in FIG. 6, at least at three locations on a base plate 51*e* in the conversion device main body 51-1, spacers 120 can be also protruded from the base plate 51*e* and can be formed integrally with the base plate 51*e*. In the case of providing the spacers 120 on the base plate 51*e*, they can be formed through the press working. This can provide the advantage of ease of the processing.

It has been described above that the locations at which the at least three spacers 120 are positioned are arbitrary. However, it is preferable that the locations at which the three spacers 120 are positioned are spaced apart from each other as much as possible, in view of the stability of the conversion device main body 51 or the conversion device main body 51-1 with respect to the mounting plate 110. For example, a single location of the spacer can be provided in each of the left and right sides of the upper portion of the mounting plate 110 and, further, another single location thereof can be provided at the center of the lower portion in the mounting plate 110.

Further, it is not necessarily required that the spacers 120 are formed integrally with the mounting plate 110 and the base plate 51*e*, and spacers 120 separated from the mounting plate and the base plate can be also placed onto at least one of the mounting plate 110 and the base plate 51*e*.

Figure 5:
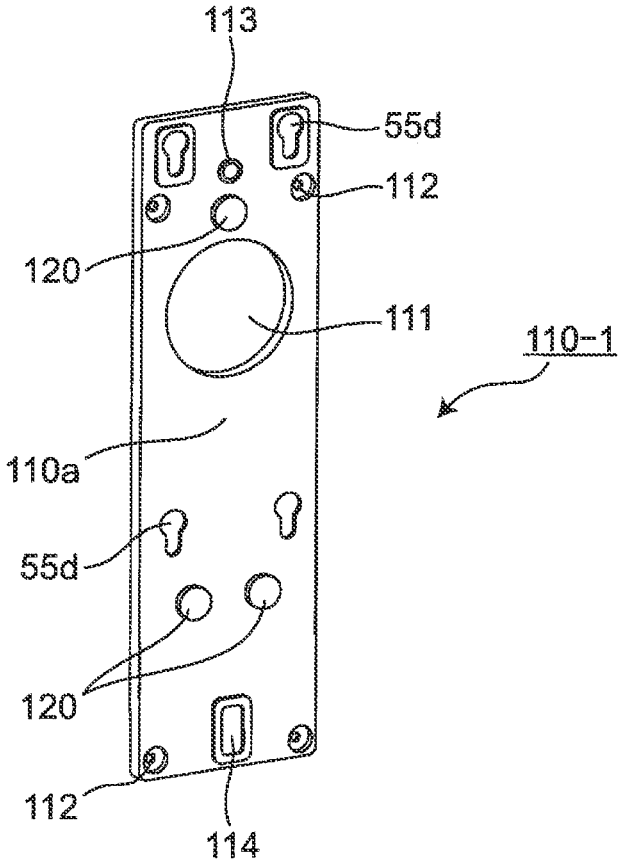
FIG. 5 is a perspective view illustrating an example of modification of the mounting plate included in the conversion device illustrated in FIG. 1, illustrating the mounting plate including spacers placed in a different manner.

Namely, the spacers 120 are members required only to create the gap 121 between the conversion device main body 51 and the front surface 110*a* of the mounting plate 110. Further, although the spacers 120 having a circular-plate shape are illustrated in FIGS. 5 and 6, the shapes of the spacers 120 are not limited.

Next, there will be described the mounting of the aforementioned mounting plate 110 to the main body wall portion 5 in the manual beer server 20.

As illustrated in FIG. 7, in the present embodiment, the manual beer server 20 includes the screw holes 21 at five positions on the main body wall portion 5 corresponding to the fastening-member holes 112 and the reinforcement fastening-member hole 113 in the mounting plate 110. Accordingly, with respect to the main body wall portion 5 in the state where the liquid discharging portion 1 has been disengaged therefrom and the lever mounting portion 3 is protruded therefrom, the lever mounting portion 3 is inserted through the liquid discharging portion opening 111 in the mounting plate 110, and the mounting plate 110 is set on the main body wall portion 5. Further, as illustrated in FIG. 8, for example, round screws, which correspond to an example of the fastening members 130, are screwed and fastened through the fastening-member holes 112 in the mounting plate 110, thereby securing the mounting plate 110 to the main body wall portion 5.

As described above, in the present embodiment, securing the mounting plate 110 to the manual beer server 20 is performed with the fastening members 130 and, therefore, this securing can be attained easily and firmly in a shorter time. Further, whole of the back surface 110*b* of the mounting plate 110 comes in contact with the main body wall portion 5 to be supported thereby. This enables forming the mounting plate 110 from a resin material as described above. Further, the mounting plate 110 is completely prevented from being deformed during being secured. This eliminates the necessity of supporting the conversion device main body 51 with the entire front surface 110*a* of the mounting plate 110. This enables forming the gap 121 with the spacers 120, between the front surface 110*a* and the conversion device main body 51, as described above. As a result thereof, as already described, it is possible to substantially eliminate the possibility of occurrences of inconvenience at the time of maintenance of the conversion device 150.

Further, there is a need for attaching and detaching the liquid discharging portion 1 with respect to the lever mounting portion 3 for daily washing. On the other hand, in the case of the existing conversion device 50, as described above, the lever mounting portion 3 and its periphery are used when securing the base plate 55*a* onto the manual beer server 10. Accordingly, in the existing conversion device 50, attaching and detaching the liquid discharging portion 1 with respect to the lever mounting portion are complicated.

On the contrary, in the present embodiment, the fastening members 130 are used, while the lever mounting portion 3 and its periphery are not used, in securing the mounting plate 110. This enables easily attaching and detaching the liquid discharging portion 1 with respect to the lever mounting portion 3 in a shorter time, in comparison with the case of the existing conversion device 50.

In the present embodiment, screws are used as the fastening members 130 as described above. However, the fastening members 130 are not limited to screws. For example, full threads or stud bolts are protruded from the main body wall portion 5 in the manual beer server 20, and after they are inserted through the fastening-member holes 112 in the mounting plate 110, securing the mounting plate 110 can be performed by engaging nuts with the full threads or stud bolts.

In the aforementioned way, the mounting plate 110 is secured to the main body wall portion 5 in the manual beer server 20. Further, after the securing, the hook members 51*f* in the conversion device main body 51 are engaged with the main body mounting openings 55*d* in the mounting plate 110, further, the conversion device main body 51 is moved downwardly, and the latch claw 51*g* in the conversion device main body 51 is engaged with the latch opening 114 in the mounting plate 110. Further, in the present embodiment, the reinforcement fastening member 131 is screwed from the lever operation portion 51*a*, in order to couple the lever operation portion 51*a* in the conversion device main body 51 and the main body wall portion 5 in the manual beer server 20 to each other.

Due to the reinforcement fastening member 131, the conversion device main body 51 not only can be mounted to the manual beer server 20 through the mounting plate 110 interposed therebetween, but also can be directly secured to the manual beer server 20. Accordingly, even if an excessive external force is applied to the conversion device main body 51, such as collision of a person with the conversion device main body 51, for example, it is possible to prevent and inhibit damages of the main body mounting openings 55*d* in the mounting plate 110, which keep the mounting plate 110 engaged with the hook members 51*f* (FIG. 6) in the conversion device main body 51.

Further, beer supplying operations with the conversion device main body 51 in the conversion device 150 according to the present embodiment are the same as those with the existing conversion device 50, and thus are not described herein.

Figure 9:
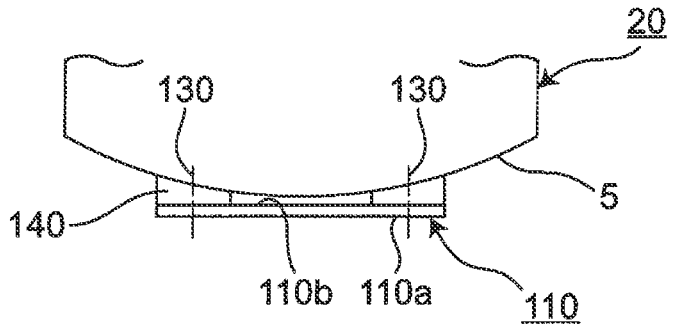
FIG. 9 is a view illustrating a state where the conversion device illustrated in FIG. 1 has been mounted to the manual beer server, in a case where a main body wall portion in the manual beer server forms a non-flat surface.

In the present embodiment, the main body wall portion 5 in the manual beer server 20 forms a flat surface, which enables securing the mounting plate 110 with a flat-plate shape directly to the main body wall portion 5. On the other hand, there are some manual beer servers 20 including a main body wall portion 5 which forms a non-flat surface, such as a curved surface, for example, as illustrated in FIG. 9. In such cases, between the back surface 110*b* of the mounting plate 110 and the main body wall portion 5 with the curved surface, a pedestal member 140 for filling a gap between them can be attached on the back surface 110*b*. In this case, the pedestal member 140 is formed by a material with rigidity, such as a metal member, a resin member and the like, for example, in order to certainly secure the mounting plate 110 to the main body wall portion 5.

Further, arbitrary embodiments out of the aforementioned various embodiments can be properly combined to provide their respective effects.

Although the present invention has been sufficiently described with respect to preferred embodiments, with reference to the accompanying drawings, various changes and modifications are apparent to those skilled in the art. It should be understood that such changes and modifications which fall within the scope of the present invention defined by the appended claims are embraced therein.

Further, the contents of the disclosures in the specification, the drawings, the claims and the abstract in Japanese Patent Application No. 2016-230765 filed on Nov. 29, 2016 are incorporated herein in their entirety as reference.

INDUSTRIAL APPLICABILITY

The present invention is applicable to a conversion device for converting a manual liquid supply device into an automated liquid supply device by being mounted to the manual liquid supply device.

DESCRIPTION OF REFERENCE SYMBOLS

1 LIQUID DISCHARGING PORTION
1*a* OPERATION LEVER
5 MAIN BODY WALL PORTION
20 MANUAL BEER SERVER
51 CONVERSION DEVICE MAIN BODY
55*d* MAIN BODY MOUNTING OPENING
110 MOUNTING PLATE
110*a* FRONT SURFACE
110*b* BACK SURFACE
111 LIQUID DISCHARGING PORTION OPENING
112 FASTENING-MEMBER HOLE
113 REINFORCEMENT FASTENING-MEMBER HOLE
120 SPACER
121 GAP
130 FASTENING MEMBER
131 REINFORCEMENT FASTENING MEMBER
140 PEDESTAL MEMBER
150 CONVERSION DEVICE

The invention claimed is:

1. A conversion device configured to convert a manual liquid supply device into an automated liquid supply device by mounting of the conversion device to the manual liquid supply device, the manual liquid supply device including a liquid discharging portion, the liquid discharging portion being protruded from a mounting surface of the manual liquid supply device and configured to discharge and stop the discharge of liquid with an operation of a manual operation member in the liquid discharging portion, the conversion device comprising:

an automated operation portion configured to automatically operate the manual operation member; and a mounting plate made of a resin, positioned between the automated operation portion and the mounting surface, and configured to mount the automated operation portion to the mounting surface, the mounting plate including: a back surface facing to the manual liquid supply device and coming in contact with the mounting surface; a front surface opposed to the back surface and facing to the automated operation portion; and a liquid discharging portion opening passed through the front and back surfaces and through which the liquid discharging portion is inserted, the conversion device further comprising a spacer configured to be interspersed and sandwiched between the front surface and the automated operation portion, and configured to create a gap between the front surface and the automated operation portion, the conversion device further comprising fastening members configured to fasten the mounting plate and the mounting surface in the manual liquid supply device to each other, wherein the mounting plate includes fastening-member holes through which the fastening members are passed, the conversion device further comprising a reinforcement fastening member configured to fasten the automated operation portion and the mounting surface in the manual liquid supply device to each other, and wherein the mounting plate further includes a reinforcement fastening-member hole through which the reinforcement fastening member is passed.

2. The conversion device according to claim 1, wherein the spacer is provided on the front surface and formed integrally with the mounting plate.

3. The conversion device according to claim 1, wherein, the mounting plate includes a main body mounting opening mounting the automated operation portion thereon, and the spacer is provided on the front surface and is protruded from the front surface around a periphery of the main body mounting opening.

4. The conversion device according to claim 1, wherein the spacer is provided on the automated operation portion and is formed integrally with the automated operation portion.

5. The conversion device according to claim 1, wherein the mounting plate is a flat plate, the mounting surface in the manual liquid supply device forms a non-flat surface, and the back surface is flat and has a pedestal member configured to fill a gap between the non-flat surface and the back surface.

6. A mounting plate included in a conversion device configured to convert a manual liquid supply device into an automated liquid supply device, the mounting plate being configured to be positioned between a mounting surface in the manual liquid supply device and an automated operation portion included in the conversion device and secured to the mounting surface, and configured to mount the automated operation portion to the mounting surface, the conversion device comprising fastening members configured to fasten the mounting plate and the mounting surface in the manual liquid supply device to each other, and a reinforcement fastening member configured to fasten the automated operation portion and the mounting surface in the manual liquid supply device to each other; the mounting plate comprising:

a back surface facing to the manual liquid supply device and coming in contact with the mounting surface;

a front surface opposed to the back surface and facing to the automated operation portion; and a spacer configured to be interspersed and sandwiched between the front surface and the automated operation portion, configured to be formed integrally with the front surface, and configured to create a gap between the front surface and the automated operation portion, wherein the mounting plate is made of resin, wherein the mounting plate includes fastening-member holes through which the fastening members are passed, and wherein the mounting plate further includes a reinforcement fastening-member hole through which the reinforcement fastening member is passed.

* * * * *